US008540084B2

(12) United States Patent
Waksul

(10) Patent No.: US 8,540,084 B2
(45) Date of Patent: Sep. 24, 2013

(54) PLATE STANDS FOR VARIOUS PLATE ASSORTMENTS

(76) Inventor: Isaac Waksul, Long Beach, CA (US)

( * ) Notice: Subject to any disclaimer, the term of this patent is extended or adjusted under 35 U.S.C. 154(b) by 122 days.

(21) Appl. No.: 13/134,636

(22) Filed: Jun. 13, 2011

(65) Prior Publication Data

US 2011/0240575 A1 Oct. 6, 2011

Related U.S. Application Data

(63) Continuation-in-part of application No. 13/065,175, filed on Mar. 16, 2011.

(60) Provisional application No. 61/341,874, filed on Apr. 6, 2010.

(51) Int. Cl.
*A47G 19/08* (2006.01)
*A47J 47/16* (2006.01)

(52) U.S. Cl.
USPC ..... 211/41.2; 211/71.01; 248/174

(58) Field of Classification Search
USPC ..... 211/41.1, 41.2, 41.6, 41.7, 60.1, 211/62, 64, 65, 66, 69.1, 70.1, 70.2, 70.3, 211/70.5, 70.7, 70.8, 71.01, 72, 73, 85.18, 211/85.7, 132.1, 133.4, 196, 205, 207; 248/146, 248/150, 152, 174, 460; 294/143, 161; D6/460, 469; 108/101
See application file for complete search history.

(56) References Cited

U.S. PATENT DOCUMENTS

| | | | | |
|---|---|---|---|---|
| 152,550 | A | 6/1874 | Collins | |
| 481,404 | A * | 8/1892 | Jesser | 211/133.1 |
| 563,562 | A * | 7/1896 | Burns | 211/71.01 |
| 601,753 | A | 4/1898 | Kaiser | |
| 953,007 | A | 3/1910 | Haller | |
| 995,120 | A * | 6/1911 | Cooper | 211/41.13 |
| 1,091,026 | A | 3/1914 | Traugol | |
| 1,093,450 | A * | 4/1914 | McLaughlin | 108/109 |
| 1,334,545 | A | 3/1920 | Londelius, Jr. | |
| D75,828 | S | 7/1928 | Canfield | |
| 2,051,093 | A * | 8/1936 | Leigh | 211/72 |
| 2,087,375 | A | 7/1937 | Erhardt | |
| 2,313,620 | A * | 3/1943 | Brunner | 211/70.1 |
| D164,503 | S | 9/1951 | Kerr | |
| D176,818 | S | 1/1956 | Robinson | |
| 2,905,332 | A * | 9/1959 | Myers | 211/70.1 |
| 2,946,452 | A | 7/1960 | Caliolero et al. | |
| 3,039,618 | A * | 6/1962 | Gabriel | 211/132.1 |
| 3,040,881 | A * | 6/1962 | McNeill | 211/85.1 |
| 3,228,304 | A | 1/1966 | Graves | |
| D218,616 | S | 9/1970 | Owen | |
| 3,655,063 | A | 4/1972 | Landry | |
| 3,825,216 | A * | 7/1974 | Rodvien | 248/174 |
| 4,330,065 | A * | 5/1982 | Haddad | 211/70.5 |
| 4,338,866 | A * | 7/1982 | Streit | 108/191 |

(Continued)

*Primary Examiner* — Joshua Rodden

(74) *Attorney, Agent, or Firm* — Curtis L. Harrington; Harrington & Harrington

(57) ABSTRACT

An interlocking assembly of two generally rectangular panel pairs hinged to each other with one edge of each of the panels including a plurality of recess cut-outs aligned adjacent matching cut-outs in an adjacent edge of the other panel of the respective panel pair in which dishes can be engaged in a cantilevered manner. A telescoping handle extends across the two generally rectangular panel pairs to select the degree of the hinged articulation between the panels of the two generally rectangular panel pairs. To insure a conforming capture of the dishes the respective cut-outs may be covered with a resilient covering.

14 Claims, 7 Drawing Sheets

(56) References Cited

U.S. PATENT DOCUMENTS

| | | | | | |
|---|---|---|---|---|---|
| 4,618,115 | A | * | 10/1986 | Belokin, Jr. | 248/174 |
| 4,787,522 | A | * | 11/1988 | Nocek et al. | 211/85.15 |
| 4,911,308 | A | | 3/1990 | Nylund | |
| D319,361 | S | | 8/1991 | Moser | |
| 5,064,236 | A | | 11/1991 | Stanfield | |
| 5,088,605 | A | | 2/1992 | Nales | |
| D329,563 | S | | 9/1992 | Rasmussen | |
| 5,195,642 | A | * | 3/1993 | Dardashti | 211/40 |
| 5,301,819 | A | * | 4/1994 | Moeken | 211/40 |
| 5,450,967 | A | * | 9/1995 | Mallory | 211/30 |
| D362,776 | S | | 10/1995 | Thorn | |
| 5,538,145 | A | | 7/1996 | Held | |
| 5,542,731 | A | * | 8/1996 | Wills | 294/161 |
| 5,836,458 | A | | 11/1998 | Nales | |
| D405,300 | S | | 2/1999 | Regan | |
| 5,944,200 | A | | 8/1999 | Nales | |
| 6,070,743 | A | * | 6/2000 | Hsueh | 211/40 |
| 6,269,961 | B1 | * | 8/2001 | Porcelli | 211/70.7 |
| 6,749,208 | B2 | | 6/2004 | Orozco et al. | |
| D543,078 | S | * | 5/2007 | Davalos | D7/701 |
| 7,520,550 | B2 | | 4/2009 | Lord | |
| D601,841 | S | | 10/2009 | Neufeld | |
| 2004/0159759 | A1 | * | 8/2004 | Schultz | 248/316.2 |
| 2008/0237169 | A1 | | 10/2008 | May | |
| 2009/0195005 | A1 | * | 8/2009 | Lord | 294/161 |

* cited by examiner

PLATE STANDS FOR VARIOUS PLATE ASSORTMENTS

REFERENCE TO RELATED APPLICATIONS

This application is a continuation-in-part of U.S. patent application Ser. No. 13/065,175 filed on Mar. 16, 2011, which, in turn, obtains the benefit of the earlier filing date of U.S. Provisional Patent Application No. 61/341,874 filed on Apr. 6, 2010, and the benefit of these earlier dates is claimed for all matter common therewith.

BACKGROUND OF THE INVENTION

1. Field of the Invention

The present invention relates to dish carriers, and more particularly to a plurality of panel assembly hinged to each other for supporting arrays of dishes both in the course of their delivery and also as a stationary support.

2. Description of the Prior Art

Those engaged in preparing and serving food for consumption by others have consistently faced the burdens an array of dishes entails, particularly when more than one person is being served a full meal at a dining table. In commercial settings this burdensome task has been partly assisted by large carrying trays that were then placed either on any adjacent vacant table, or more frequently, on collapsible stands temporarily erected next to the table being served. The manipulative difficulty of a large tray on its fully loaded path from the kitchen has nonetheless become legendary, even providing endless comedic sequences in many of our films, and various mechanical alternatives were therefore devised to assist the overburdened food service provider.

These earlier assisting mechanical alternatives fall generally into three groupings of dish carrier assemblies that also serve as a stand, the first arranged as a cage within which the dishes are suspended by their edges or arranged as a stack, exemplified by the teachings of U.S. Pat. No. 5,064,236 to Stanfield; U.S. Pat. No. 5,542,731 to Wills; and others; the second in which dish supporting trays, supports or shelves are cantilevered from a common axis that is provided with a support base, as in U.S. Pat. No. 953,007 to Haller; U.S. Pat. No. 4,911,308 to Nylund; U.S. Pat. No. 6,749,208 to Orozco et al.; and others; and the third in which the peripheral edge of each dish is captured in a cantilevered manner within exteriorly directed notch structures around a common carrying axis that also serves as a support base, as in U.S. Pat. Nos. 5,088,605, 5,836,458 and 5,944,200 all to Nales; U.S. Pat. No. 7,520,550 and US publication 2009/0195005 to and by Lord; and many others.

Each of the foregoing, while suitable for the purposes intended, either entails a complex, costly and often cumbersome structure, as exemplified by those in the first two groupings, or the simpler, but more precariously suspended and therefore difficult to manipulate, carrying arrangement in which the engaged dish peripheries are relied on to carry the whole plate loading. Both these modalities are particularly bothersome in a busy restaurant setting and a simply constructed dish carrying arrangement that obtains the benefits and deployment convenience of the cantilevering dish edge capture, but in a more stable and redundant form, is therefore extensively desired and it is one such arrangement that is disclosed herein.

SUMMARY OF THE INVENTION

Accordingly, it is the general purpose and object of the present invention to provide a simply assembled dish carrying structure in which the carried food laden dishes are resiliently retained in cantilevered engagement at varying levels of insertion.

Other objects of the invention are to provide a dish carrying assembly which is easily separated into conveniently stored panels.

Yet further and additional objects of the invention shall become apparent upon the examination of the description that follows in conjunction with the illustrations appended hereto.

Briefly, these and other objects are accomplished within the present invention, in accordance with a first mode of implementation thereof, by providing a pair of generally similar orthogonally interlocking structures each defined as a vertically elongate rectangular panel provided at the top and bottom edges with corresponding co-planar upper and lower lateral extensions each notched by opposingly aligned transverse grooves conformed for crossed mating receipt within each other. Once thus interlocked the resulting crossed structural combination then provides the necessary three dimensional engagement which can either serve as a stand or as a carrying assembly which may be facilitated by forming a handle in the panel that is provided with the upwardly open interlocking grooves.

The panel edges between the lateral extensions are each provided with matching cut-outs each covered with a resilient edge covering and each shaped so that in their crossing interlocked combination conformingly matched edge recesses are provided in which correspondingly shaped peripheral portions of dishes are receivable for a resiliently effected cantilever moment capture of the dish. In this manner various dish shapes may conveniently accommodated by the simple expedient of the cut-out shape, reducing fabrication costs and the need for specialized inventory. Of course, the planar nature of the two main components of this inventive assembly, and also their similar planforms, provide both manufacturing and great storage convenience when not in use.

In accordance with a second mode of implementation of the invention herein the engagement between the panels may be modified to include hinges in lieu of the interlocking grooves so that each cooperative panel pair is fixed in a hinged relationship, with the free edges of a hinged panel pair, in turn, hinged to the free edges of yet another hinged panel pair. Similar to the first implementation mode, the adjacent edges of each hinged panel pair include the above matched edge recesses shaped to receive in cantilever suspension variously sized dishes, thus effectively doubling carrying capacity. In this hinged form the assembly may be once again collapsed for storage in an overlying panel stack from which it can be expanded into a three-dimensional form when needed to support or carry dishes. A telescoping tubular handle assembly extending between the upper hinges joining the recessed edges of each panel pair is then utilized to provide manual carrying convenience, the telescoping collapse of the handle assembly deploying the panel stack into its three-dimensional form for supporting dishes with the inherent flexure of the telescoped handle when used to lift the assembly insuring the retention of this three dimensional form in the course of its movement.

Thus in both forms an easily stored structural combination is obtained which can be rendered in any convenient material structures and which, by the shaping convenience of the edge capturing recesses, can include multiple geometric shapings to capture in a cantilevered manner the edges of various dish forms so that inadvertent dropping of the dishes received therein is effectively precluded.

DESCRIPTION OF THE PREFERRED EMBODIMENTS

Figure 2:
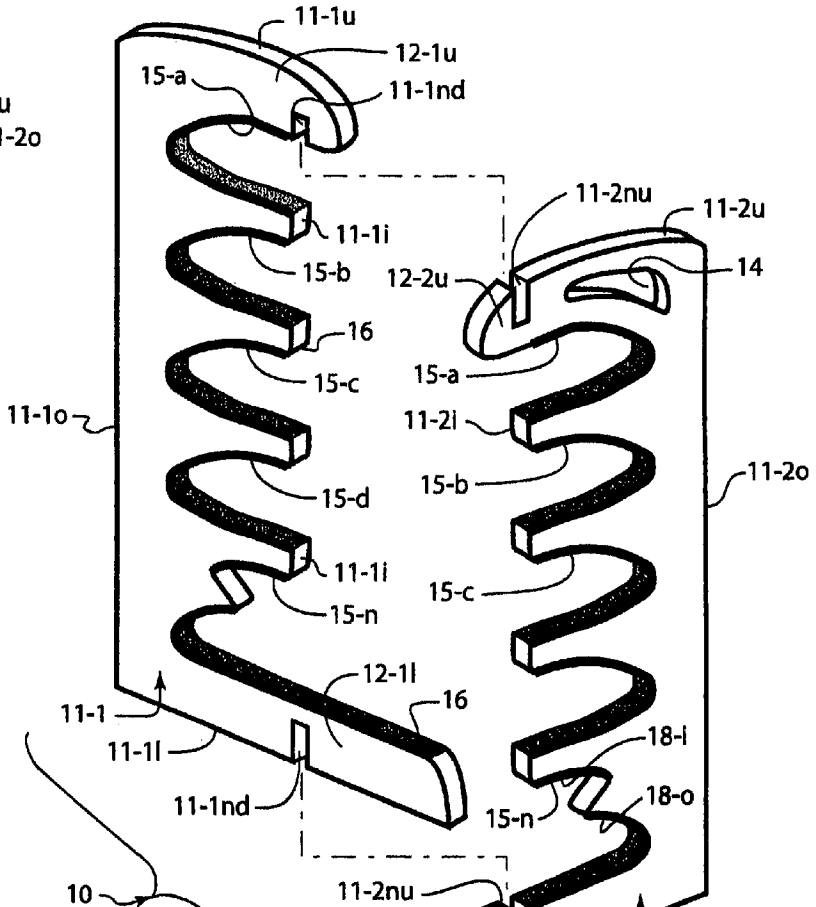
FIG. 2 is a perspective illustration of a first embodiment of the inventive dish carrying structural assembly shown in FIG. 1 separated by its parts.
Figure 1:
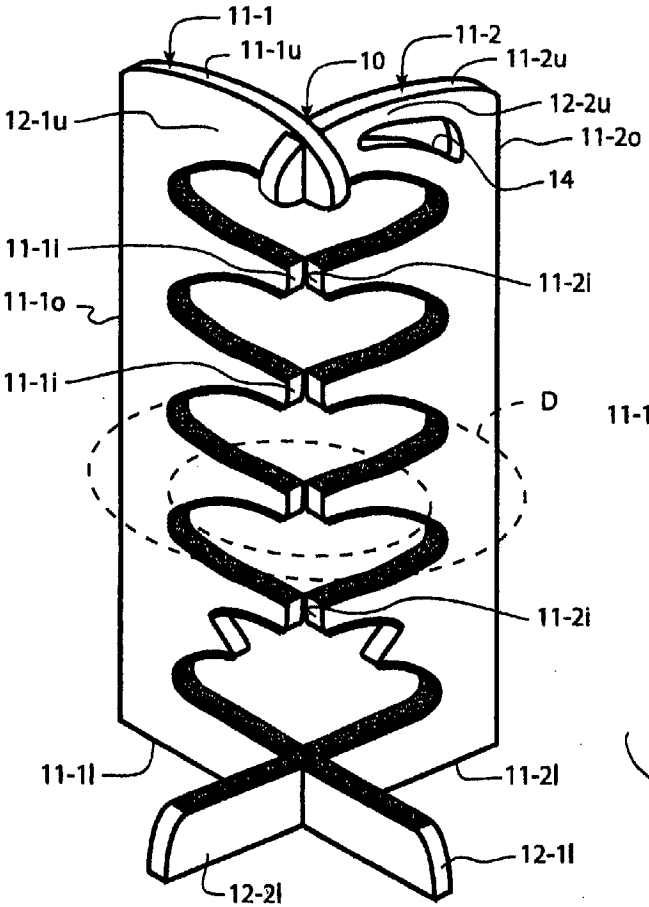
FIG. 1 is a perspective illustration of a first embodiment of the inventive dish carrying structural assembly in its interlocked and deployed form.
Figure 4:
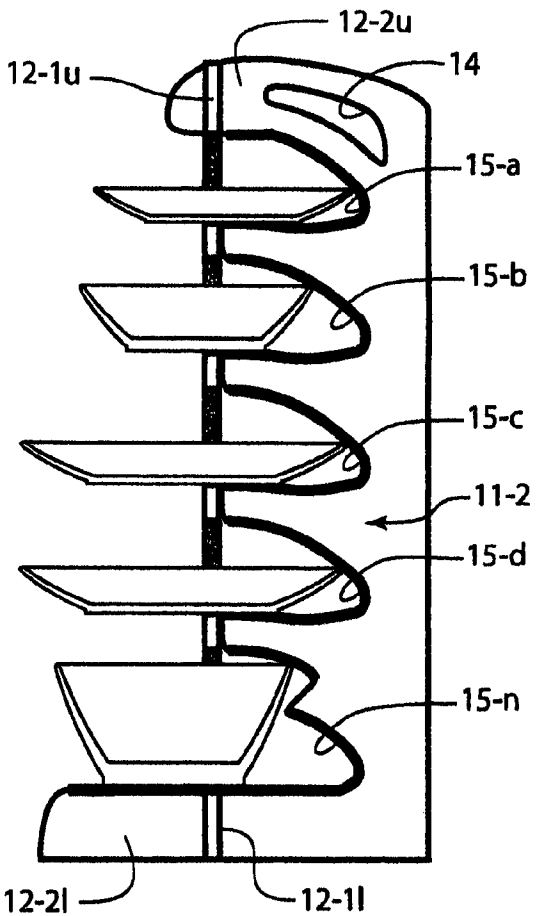
FIG. 4 is a side view of the inventive dish carrying structural assembly shown in FIG. 2.
Figure 3:
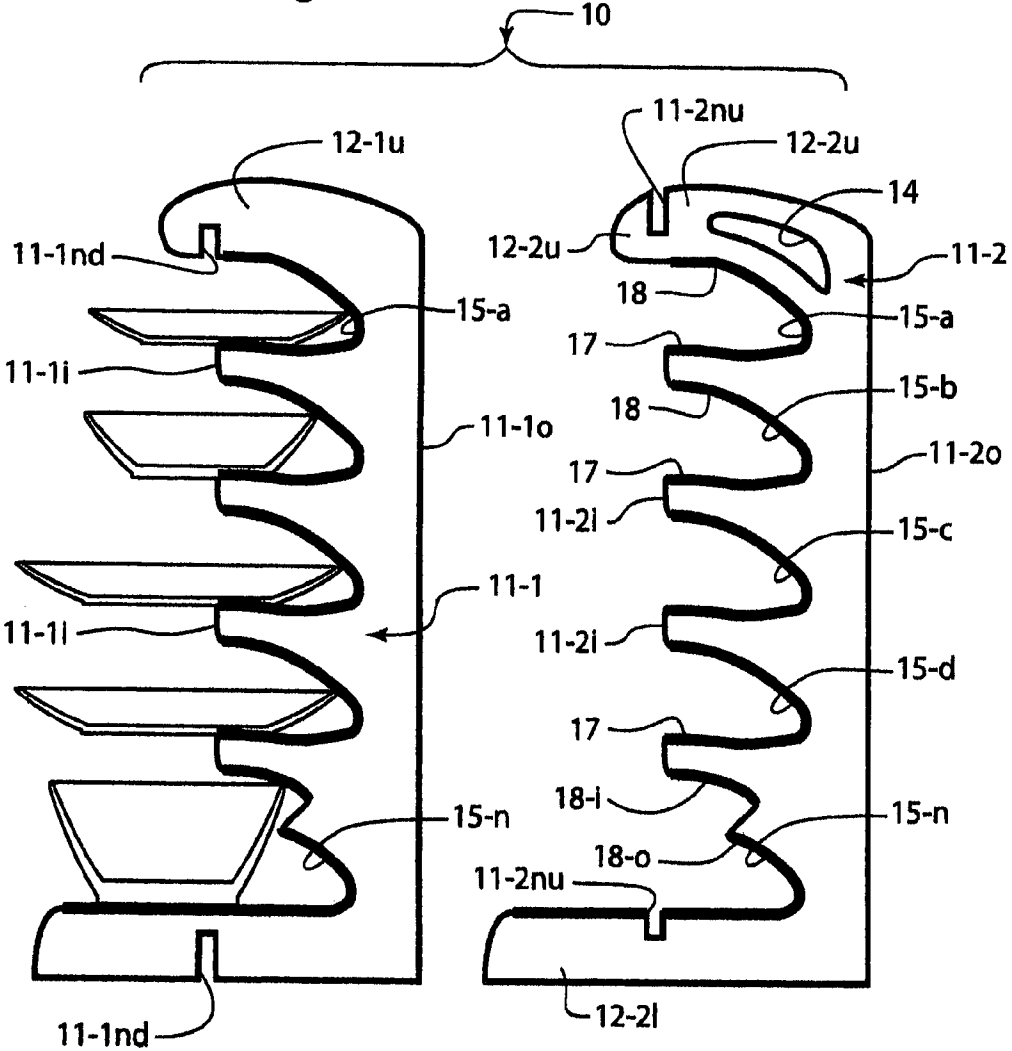
FIG. 3 is a plan view, again separated by parts, of the inventive dish carrying structural assembly shown in FIG. 1.
Figure 5:
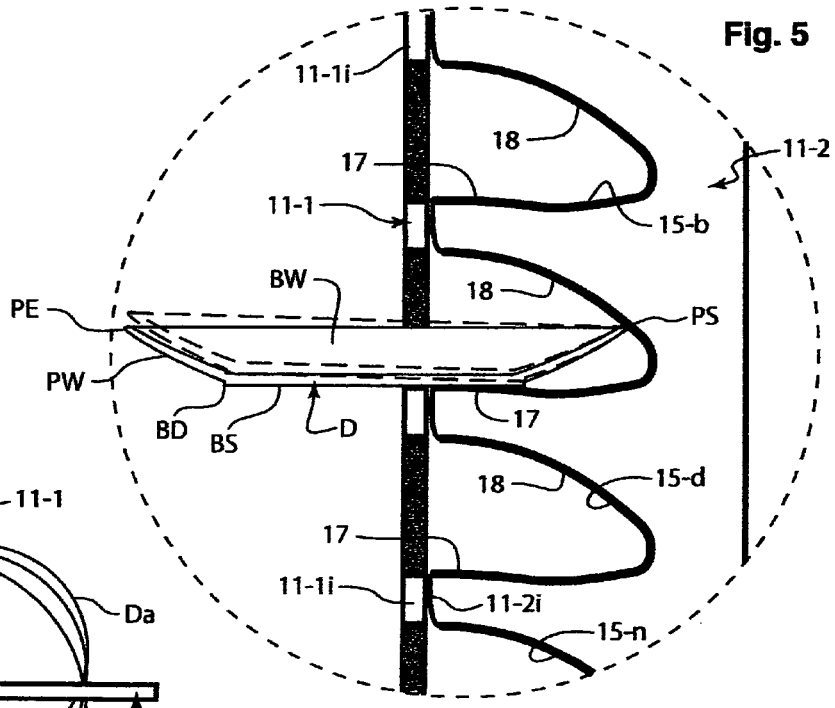
FIG. 5 is a side view detail of one portion of the inventive dish carrying shown in FIGS. 1-4.

As shown in FIGS. 1-6 the first implementation of the inventive dish carrier assembly, generally designated by the numeral 10, comprises a pair of substantially similar generally planar panels which by their substantial similarity shall be designated herein by the trailing numerals 1 and 2, where the respective panels 11-1 and 11-2 are each of an elongate, generally rectangular planform respectively defined by inner and outer longitudinal edges 11-1*i* and 11-1*o* and 11-2*i* and 11-2*o*. Transversely an upper and a lower edge 11-1*u* and 11-1*l* and 1-2*u* and 11-2*l* limit the planform of the respective panels 11-1 and 11-2, each of the upper and lower edges extending beyond the corresponding inner edges 11-1*i* and 11-2*i* to continue as the exterior edges of corresponding upper and a lower planar extensions 12-1*u* and 12-1*l* and 12-2*u* and 12-2*l*, with the lower extensions 12-1*l* and 12-2*l* on each panel being greater in width and spanning further from the corresponding inner edges 11-1*i* and 11-2*i* than the upper extensions 12-1*u* and 12-2*u*.

To effect an interlock between the panels the interior edge of the upper extensions of panel 11-1, immediately proximate its inner edge 11-1*i*, is transversely notched by an downwardly open notch 11-1*nd* with a conformingly similar, but upwardly directed, transverse notch 11-2*nu* formed in the corresponding upper edge 11-2*u* of panel 11-2 with a similar, opposingly directed, set of conforming notches 11-2*nu* and 11-1*nd* formed in the lower inner edge of the extension 12-1*l* and the lower extension 12-2*l*. These last opposing notches, and also the corresponding extensions in which they are formed, are each somewhat deeper, and correspondingly also wider in their planform, in order to simplify and render convenient their sequential engagement to interlock the panels 11-1 and 11-2 in a crossed relationship.

In this interlocked configuration the inner edges 11-1*i* and 11-2*i* align in a closely adjacent, but substantially orthogonal, relationship with the crosswise engaged lower extensions 12-1*l* and 12-2*l* forming a supporting base for this interlocked panel combination. A handle 14 formed in the upper extension 12-2*u* of panel 11-2 is then useful to lift the engaged panel combination from ground to serve as a conveniently assembled, and also conveniently disassembled and stored, carrier structure for dishes D that are suspended in cantilever from a set of matching panel recesses 15-*a* through 15-*n* that are formed in each of the panels in the form of mutually aligned cut-outs from the inner edges 11-1*i* and 11-2*i* into the corresponding panel and to assure a secure cantilevered engagement a resilient strip 16, such as an adhesively attachable foam rubber strip, is applied to each of the edges of the recesses 15-*a* through 15-*n*.

Those skilled in the art will appreciate that the foregoing structure is directed for use in settings where a large number of dishes need to be handled. Of course, such settings rarely involve dishes that are each an 'object d'art', i.e., a precious, extremely fragile artistic piece, but dishes D that are appropriately designed with correct contemplation for strength of materials, the sanitary aspects of the finish, mass density and the like. Simply, dishes appropriately designed for convenient handling with appropriate attention to notions like scaling laws and commercially expedient materials are those that need the handling assistance disclosed herein. These typically include a fairly large circular base with a well defined base edge circle BD supporting the bowl BW surrounded by a peripheral wall PW which either extends upwardly for those dishes that convey fluid foods or that projects generally radially to form a peripheral surface PS. In virtually all instances, however, there is a well-defined, flat, circular bottom surface BS surrounded by a peripheral edge PE that is either substantially above the bottom surface BS or close to the plane thereof.

These attributes are successfully used to advantage in the edge shaping of each of the recesses 15*a* through 15*n* by providing a convex curvature, or bulge, 17 in the bottom portion of the recess edge with a complementary conforming, but radially further from the inner edges 11-1*i* or 11-2*i*, upper edge convolution 18 that is generally spaced from the convex curvature 17 by a radial and vertical gap similar to the gap between the base surface BS and the peripheral edge PE of the particular dish configuration that is to be received in the recess. Since this geometric relationship provides a generally fixed distance between the fulcrum point supporting the base surface BS on the convex curvature 17 and the opposing contact point between the peripheral edge PE at the complementary convolution 18 in each of the panels 11-1 and 11-2 the resulting cantilevered engagement accommodates substantial misalignments of the dish D while still maintaining moment levels of the cantilevered suspension that is within the material strength capacity of the dish D.

Thus each of the recesses 15*a* through 15*d* can be conformed to accept a particular family of dishes, assuring in each instance a self-correcting shift in the fulcrum contact between the dish bottom surface BS and the curvature 17 which occurs within the recesses in both panels 11-1 and

11-2, compensating for a wide range of misalignments in the handling of the dish. Moreover, where the number of recesses is insufficient for the dish variety used the upper convolution 18 may be segmented as illustrated by the recess 15*n* where a substantially higher inner convolution segment 18-*i* extends partly into the recess to accommodate dishes that have a substantial peripheral wall PW while the remaining outer portion 18-*o* then drops to a closer spacing to accommodate flat dishes characterized by a substantial peripheral edge PE that, of course, requires deeper insertion.

Figure 6:
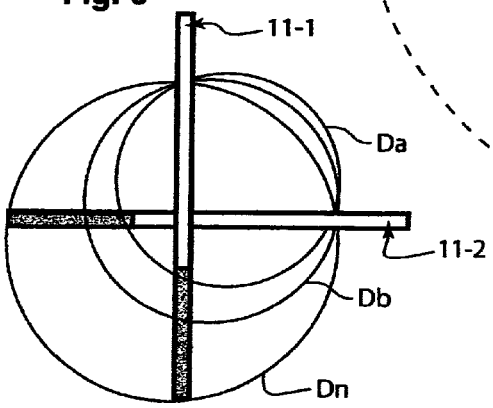
FIG. 6 is a diagrammatic top view illustrating the various dish alignments in various cantilevered captures rendered possible within the capturing recesses provided within the inventive dish carrier structural assembly.

In this manner all sorts of complementing dish configurations can be easily accommodated in a structure that is inexpensive to produce, easily disassembled and stored and conveniently used. The simple planar nature of all the interlocking components of the present invention assures all the foregoing benefits including the packaging convenience benefit when accompanying a sale of complementing dishes. Moreover, as illustrated in FIG. 6 the crossed interlocking of the panels 11-1 and 11-2 results in an accommodating cantilevered capture at various degrees of dish offsets illustrated as Da through Dn. Simply, a well centered positioning of each dish is not required as the capturing engagement can translate both along and across each panel.

Figure 7:
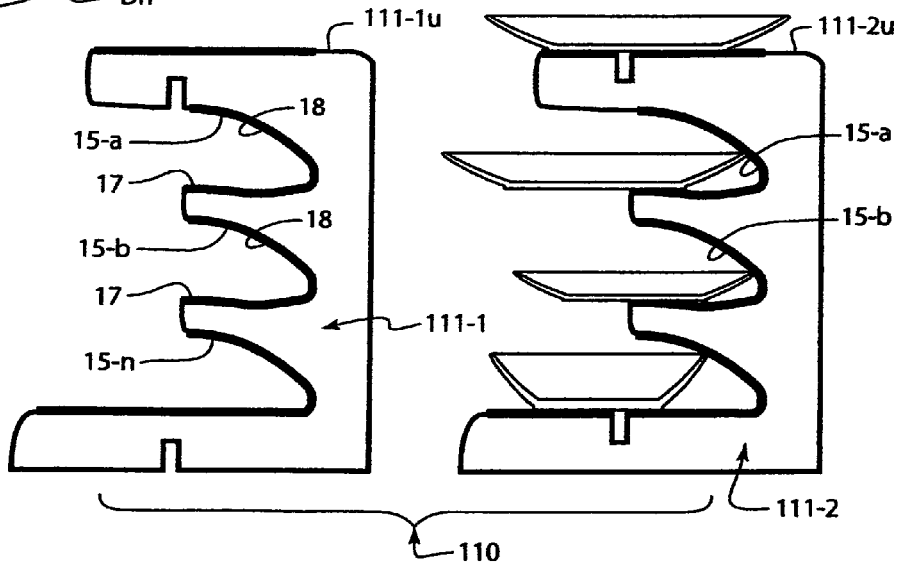
FIG. 7 is yet another side view, separated by parts, of a reduced form of the inventive dish supporting structural assembly shown in FIGS. 1-6.
Figure 8:
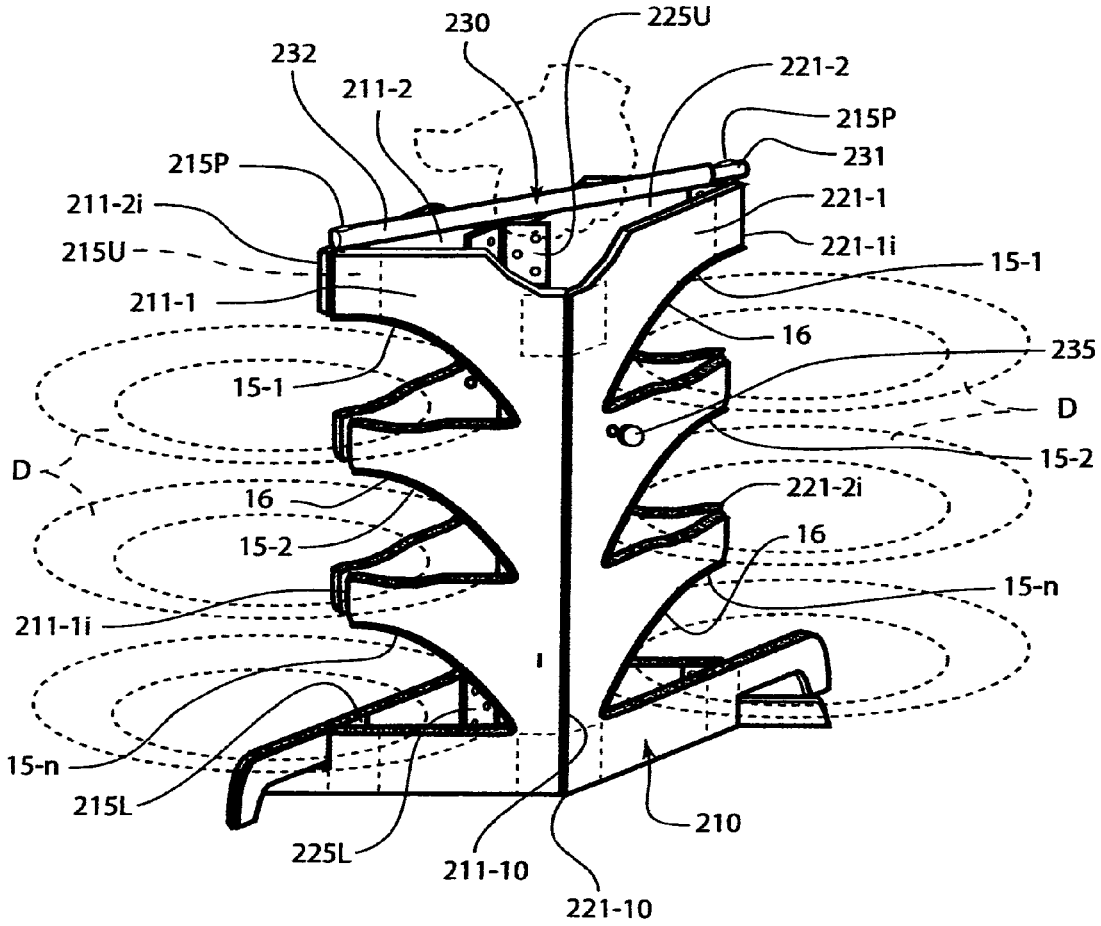
FIG. 8 is yet another perspective illustration of a second implementation of the inventive dish carrying assembly conformed as an integrated combination of a plurality of the inventive panel combinations hinged to each other.
Figure 9:
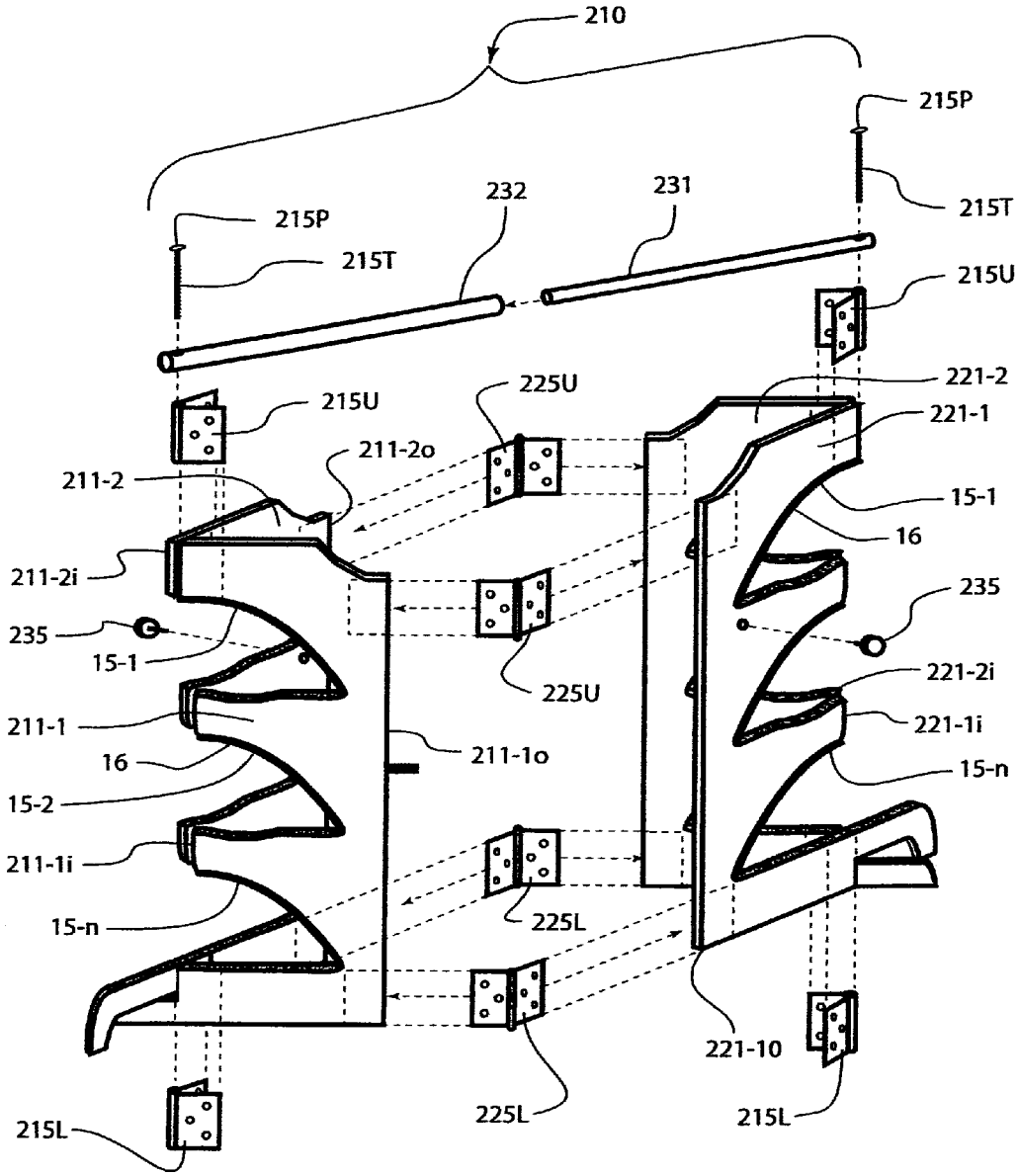
FIG. 9 is a further perspective illustration, separated by parts, of the second inventive implementation shown in FIG. 8.
Figure 11:
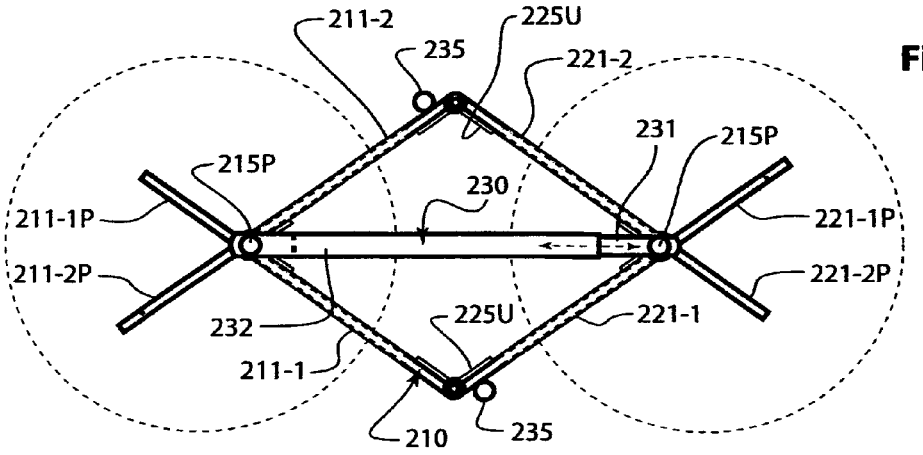
FIG. 11 is a top view of the deployed dish carrying assembly shown in FIGS. 8-10.
Figure 10:
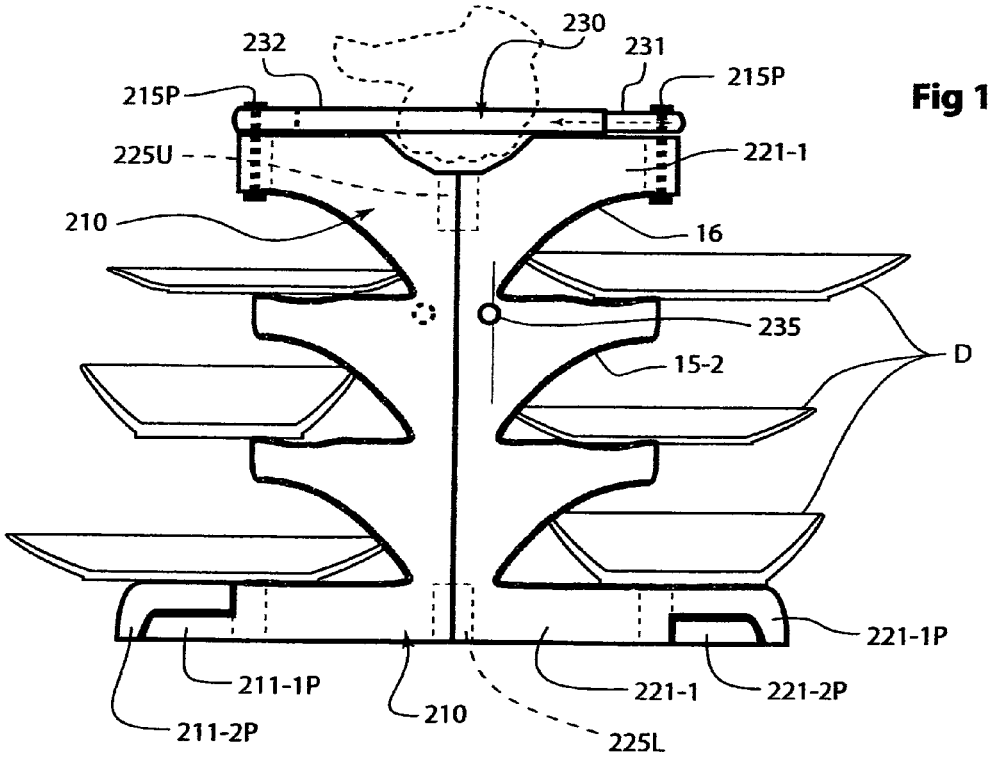
FIG. 10 is a side view of the deployed form of the second implementation of the inventive dish carrying assembly shown in FIG. 8 and illustrating the configuration thereof in the course of use.
Figure 12:
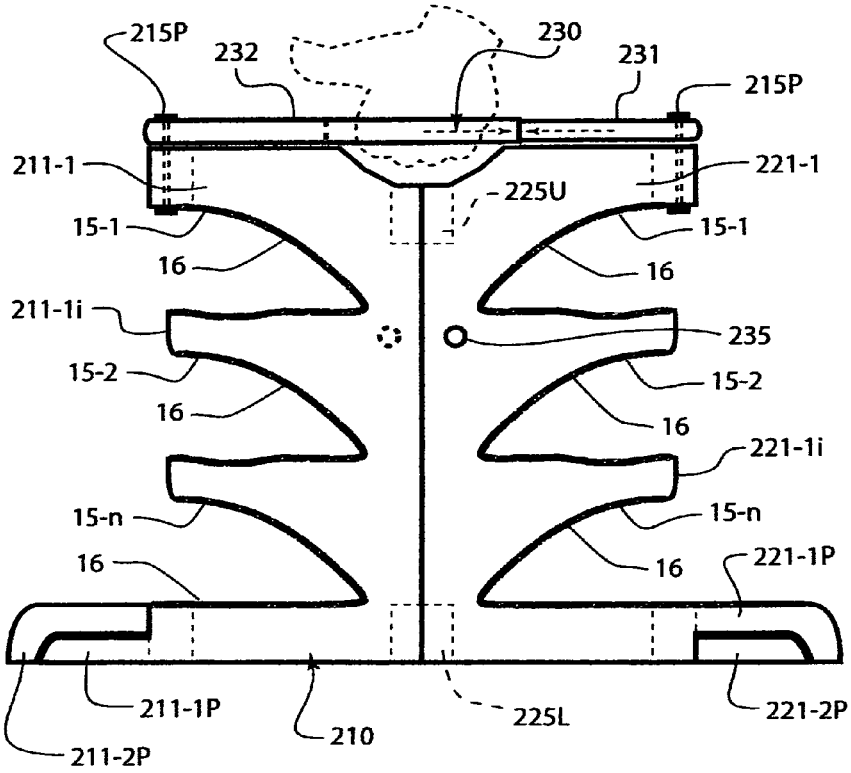
FIG. 12 is a further side view illustrating the second implementation of the inventive dish carrying assembly in its collapsed form for storage.

While the foregoing configuration includes the provision of a handle to conform the interlocked combination into a dish carrier, a simpler form illustrated in FIG. 7 useful to serve only as a dish stand generally designated by the numeral 110, comprising panels 111-1 and 111-2 again interlocked but having the handle omitted. Like numbered parts functioning in a like manner to that previously described, panels 111-1 and 111-2 are again defined by inner edges 11-1*i* and 11-2*i* which are each provided with recesses illustrated here as only recesses 15*a* and 15*n* where each are again composed of edge convolutions 18 opposed by the convex curvatures 17. Of course, the previously described interlocking notches and panel extensions are all repeated in this configuration as is also the convenience of use of the upper edges 111-1*u* and 111-2*u* to support yet another dish, each lower support also obtaining the forgiving nature of the cantilevered dish capture also previously described.

The above dish supporting benefits and fabrication convenience of a folding panel structure can be further multiplied by joining the free edges of each panel pair to the corresponding free edges of yet another panel pair in accordance with the second implementation of the present invention illustrated in FIGS. 8 through 13. By particular reference to FIGS. 8 through 10, the second inventive implementation, generally designated by the numeral 210, comprises two interconnected pairs of substantially similar, generally rectangular panels which by their substantial similarity to the panels previously described shall be designated herein as panels 211-1 and 211-2 combining to form the first panel pair and panels 221-1 and 221-2 forming the second pair with each of the panels again defined by a similarly dimensioned rectangular planform respectively defined by inner longitudinal edges 211-1*i*, 211-2*i*, 221-1*i* and 221-2*i* and outer longitudinal edges 211-1*o*, 211-2*o*, 221-10 and 221-2*o*.

Figure 13:
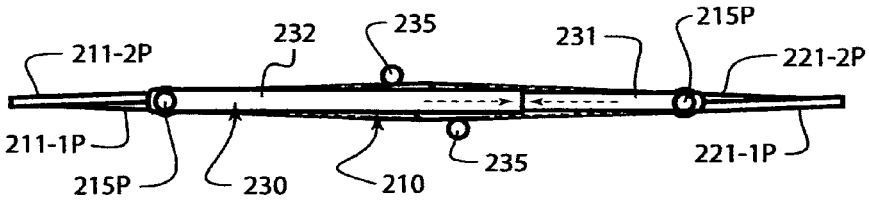
FIG. 13 is a further top view of the second implementation of the inventive dish assembly collapsed for storage.

Unlike the first inventive implementation, however, the panels of each pair are not notched for a crossing interlock but are hinged to each other instead at the upper and lower ends of their inner edges by an upper and a lower hinge 215U and 215L. A similar set of an upper and lower hinge 225U and 225L is then useful to join the upper and lower ends of each of the outer edges 221-1*o* and 221-2*o* of the second panel pair which, by virtue of the generally similar planform dimensions of each of the panels results in a hinged parallelogram structure which can be collapsed on top of each other for storage, as illustrated in FIG. 13, or expanded to the three-dimensional form illustrated in FIGS. 8 and 9 and particularly in FIG. 11.

Like numbered parts functioning in a like manner to that previously described, the hinged inner edges of each of the panel pairs are again provided with a plurality of matched edge recesses 15-1 through 15-*n* that are each lined with the resilient strip 16 to cushion and engage in cantilever the edges of received dishes D. Of course, as this second implementation entails two such panel pairs the number of dishes thus suspended is accordingly multiplied with the various dish edge engagements in each instance assured by the shaping of the various recesses as previously described.

A resilient telescoping tubular handle structure 230 comprising an inner tube segment 231 received within an outer tubular segment 232 is then engaged at the free ends thereof to hinge pins 215P of each of the upper hinges 215U to serve as a handle bridging across the hinged parallelogram formed by the panels both when collapsed for storage or when deployed to support the array of dishes D, with the flexure of the telescoped handle structure assuring a frictional engagement between the segments thereof as the loaded assembly 210 is carried. Of course, in a manner well known in the art each of the hinge pins 215P may include a threaded portion 215T to threadably engage the corresponding hinge pivot. A pair of opposing exterior pull tabs 235 adjacent the outer edges of each panel pair are then useful to expand a collapsed assembly into its three-dimensional form to be supported on the ground G (or on any other horizontal surface) to facilitate the loading and unloading of the dishes D.

While in most instances the expanded parallelogram form of this hinged assembly is sufficiently stable for the loading and unloading process each of the inner edges of each panel pair may include projections 211-1P, 211-2P, 221-1P and 221-2P extending distally in a clearing configuration below each of the lower hinges 215L to expand the supporting base dimensions which may be particularly useful in settings where large dish arrays are entailed. Of course, it will be appreciated that similar base support expansions can be also provided at each of the hinged outer edges and it will also be appreciated that the bridging deployment of the handle assembly may extend between the hinges 225U at the upper ends of the outer edges of each pair.

In this manner a conveniently fabricated and easily assembled panel combination can be easily obtained to provide various levels of dish loading capacity both for transport or as a stationary dish support. The inexpensive nature, simplicity and convenience of this dish handling arrangement can therefore be useful in commercial setting, as an adjunct assisting the sale of dish ensembles or simply as a storage mechanism in a home.

Obviously many modifications and variations of the instant invention can be effected without departing from the spirit of the teachings herein. It is therefore intended that the scope of the invention be determined solely by the claims appended hereto.

The invention claimed is:

1. A collapsible assembly useful to support in a cantilevered manner, a plurality of dishes, comprising: a first and second panel pair each including a pair of generally rectangular panels, each one of said panels defined by an inner and an outer edge, each of said first and second panel pair having the respective inner edge of the panels of each said first and second panel pair hinged to each other and the outer edges of the panels of said first panel pair hinged to corresponding outer edges of the panels of said second panel pair, said inner edges of each of the panels of each said panel pair including a plurality of matching recess cut-outs for suspending a selected one of said dishes in a cantilevered manner; and adjustable handle means connected between said first and second panel pairs for selecting the hinged alignment between corresponding ones of each said panel.

2. An assembly according to claim 1, wherein said adjustable handle means includes a telescoping handle.

3. An assembly according to claim 2, wherein the telescoping handle has a pair of oppositely disposed ends and wherein the respective ends of said telescoping handle are operatively connected to corresponding ones of the inner edges of said first and second panel pair.

4. An assembly according to claim 1, wherein each said cut-out includes a resilient cover on edges thereof.

5. An assembly according to claim 4, wherein said adjustable handle means includes a telescoping handle having a pair of opposite ends, the respective ends thereof operatively connected to corresponding ones of the inner edges of said first and second panel pair.

6. A collapsible assembly useful to support in a cantilevered manner, a plurality of dishes, comprising:

a plurality of pairs of generally rectangular panels each panel of each pair having an inner and an outer edge and having the respective inner edges of said panels comprising each said pair hinged to each other to form the respective panel pair, the outer edges of said panels of each panel pair being hinged to corresponding outer edges of said panels of another panel pairs;

a plurality of matching recess cut-outs extending along each said inner edge of each said panel of each said panel pair for suspending a selected one of said dishes in a cantilevered manner; and adjustable handle means connected between selected ones of said panel pairs for selecting the hinged alignment between corresponding ones of each said panel of said selected ones of said panel pairs.

7. An assembly according to claim 6, wherein said adjustable handle means includes a telescoping handle having a pair of respective ends, the respective ends thereof operatively connected to corresponding ones of the inner edges of said selected ones of said panel pairs.

8. An assembly according to claim 6, wherein each said cut-out is defined by an upper convolution curvature and an offset opposing lower convex curvature.

9. An assembly according to claim 7, wherein each said cut-out includes a resilient cover on edges thereof.

10. An assembly according to claim 6, wherein each said panel is further defined by an upper and a lower edge; and said adjustable handle means is connected between the upper edges of the selected ones of said panel pairs.

11. An assembly according to claim 10, wherein said adjustable handle means includes a telescoping handle having a pair of respective ends, the respective ends thereof operatively connected to the upper edges of said selected ones of said panel pairs.

12. An assembly according to claim 11, wherein: each said cut-out is defined by an upper convolution curvature and an offset opposing lower convex curvature.

13. An assembly according to claim 12, wherein each said cut-out includes a resilient cover on edges thereof.

14. An assembly according to claim 13, wherein the lower edge of each said panel of each said panel pair includes a transverse projection aligned for crossing movement relative each other.

* * * * *